United States Patent [19]

Reynolds et al.

[11] 4,314,414

[45] Feb. 9, 1982

[54] TRENCH DIGGING APPARATUS AND BEARING THEREFOR

[75] Inventors: John M. Reynolds, Wirral; Colin E. Gibson, Upton; John S. Seamans, Wirral, all of England; Anton R. F. van der Steen, Near Ruthin, Wales

[73] Assignee: Land and Marine Engineering Limited, Liverpool, England

[21] Appl. No.: 76,476

[22] Filed: Sep. 17, 1979

[30] Foreign Application Priority Data

Nov. 29, 1978 [GB] United Kingdom ..... 46574/78

[51] Int. Cl.[3] ..... E02F 5/02

[52] U.S. Cl. ..... 37/54; 37/70; 37/97; 405/161; 308/62

[58] Field of Search ..... 405/159–165; 308/72, 61, 62; 37/71, 115, 97, 70, 54; 172/801

[56] References Cited

U.S. PATENT DOCUMENTS

| | | | |
|---|---|---|---|
| 737,021 | 8/1903 | Roberts | 405/164 |
| 2,144,063 | 1/1939 | Irvin | 405/161 |
| 2,180,046 | 11/1939 | Gleissner | 308/62 |
| 2,519,348 | 5/1939 | Austin | 308/62 X |
| 3,521,387 | 7/1970 | Degelman | 37/115 X |
| 3,583,170 | 6/1971 | DeVries | 405/162 |
| 3,717,003 | 2/1973 | Bates, Jr. et al. | 405/162 |
| 3,952,532 | 4/1976 | Spearman | 405/164 |
| 3,964,803 | 6/1976 | Eftefield et al. | 172/801 X |
| 3,970,154 | 7/1976 | Bartels | 37/97 X |
| 4,022,028 | 5/1977 | Martin | 405/159 |
| 4,044,566 | 8/1977 | Biberg | 405/162 |

*Primary Examiner*—Clifford D. Crowder
*Attorney, Agent, or Firm*—Gipple & Hale

[57] ABSTRACT

A trench digging apparatus comprising a cutter wheel with picks projecting from the outer periphery thereof. An electric drive motor is provided to rotate the cutter wheel about a substantially horizontal axis. The cutter wheel is supported by a support frame which is pivoted to a basic framework of the apparatus by spherical and eccentric hinge bearings. These hinge bearings allow a limited amount of movement about a vertical axis as well as pivotal movement about a horizontal axis. The movement about a vertical axis allows the cutter wheel to turn or be oscillated to free the apparatus, correct for crabbing or enhance cutting, and the movement about the horizontal axis enables the trench depth to be varied.

11 Claims, 9 Drawing Figures

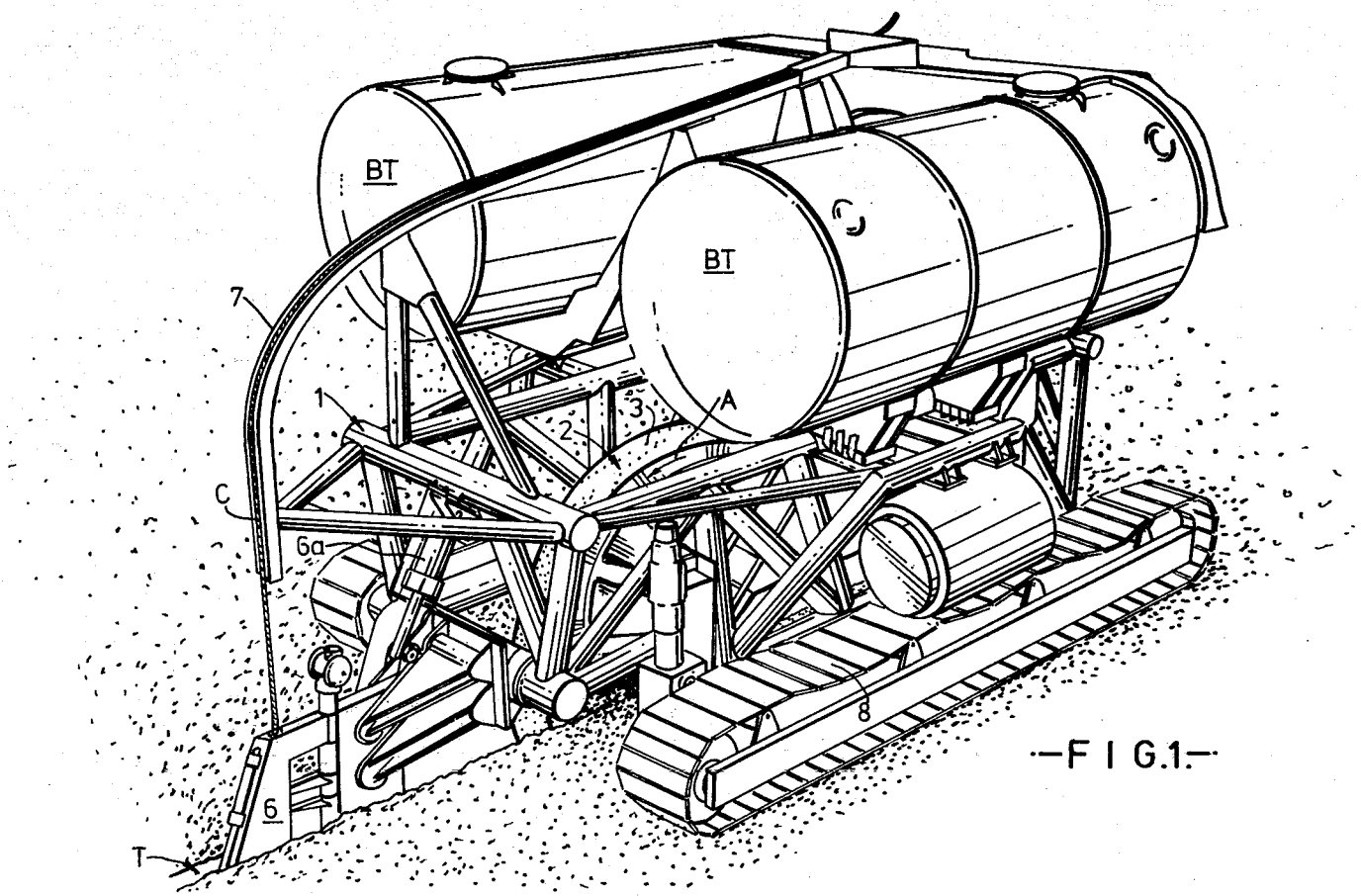
—FIG.1.—

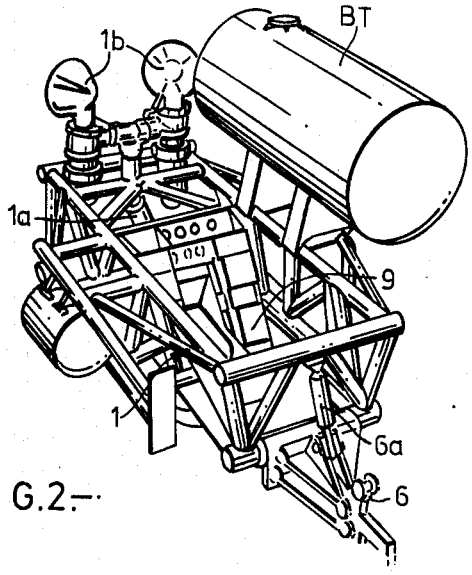
·—F I G.2.—·
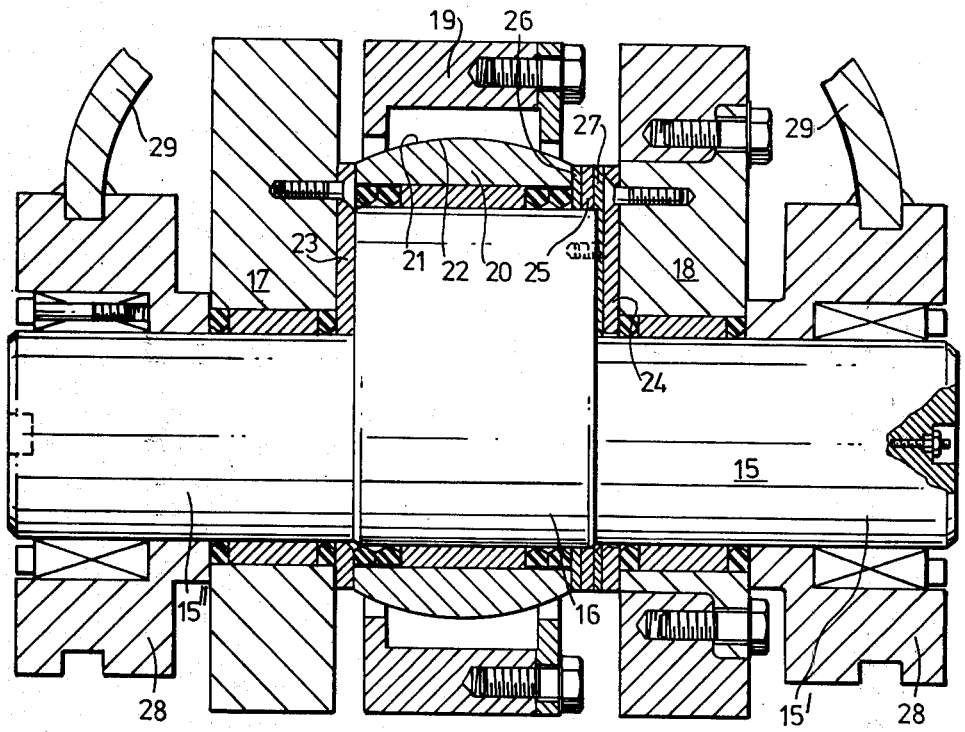
·—F I G.5.—·

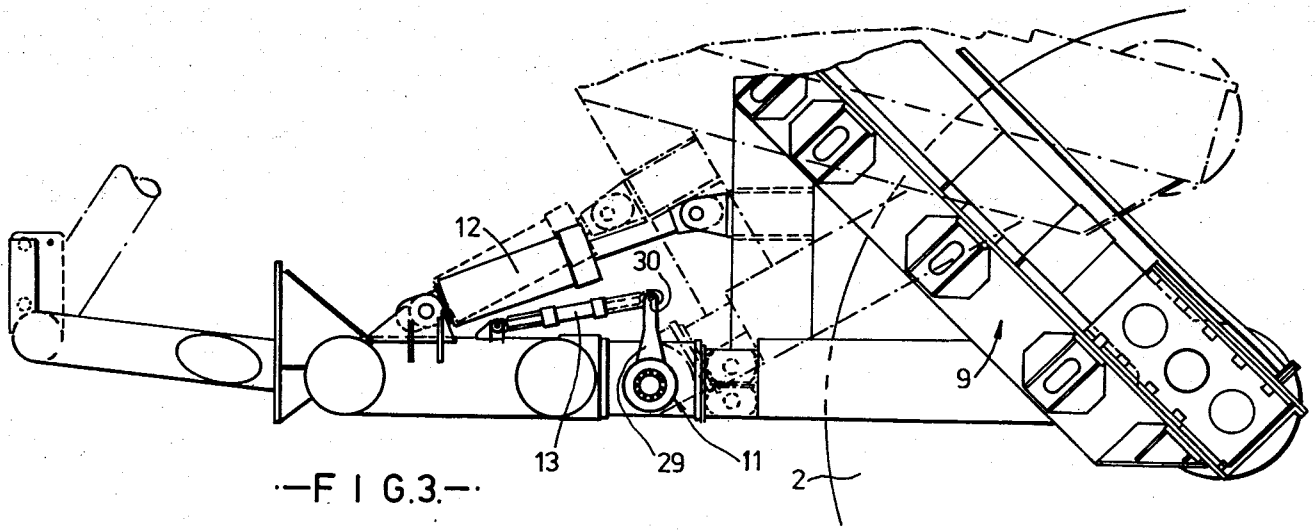
—FIG.3.—

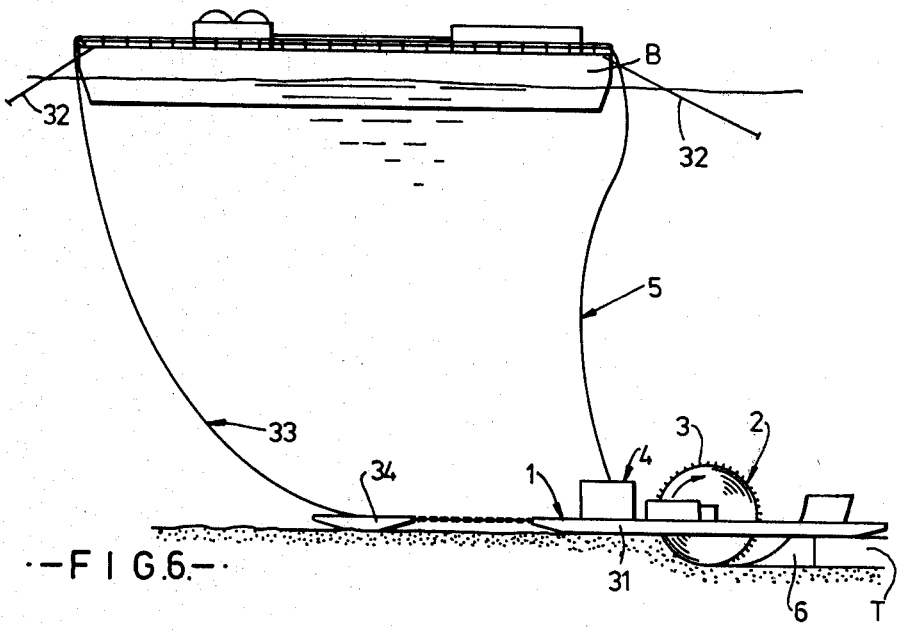
-FIG.6.-
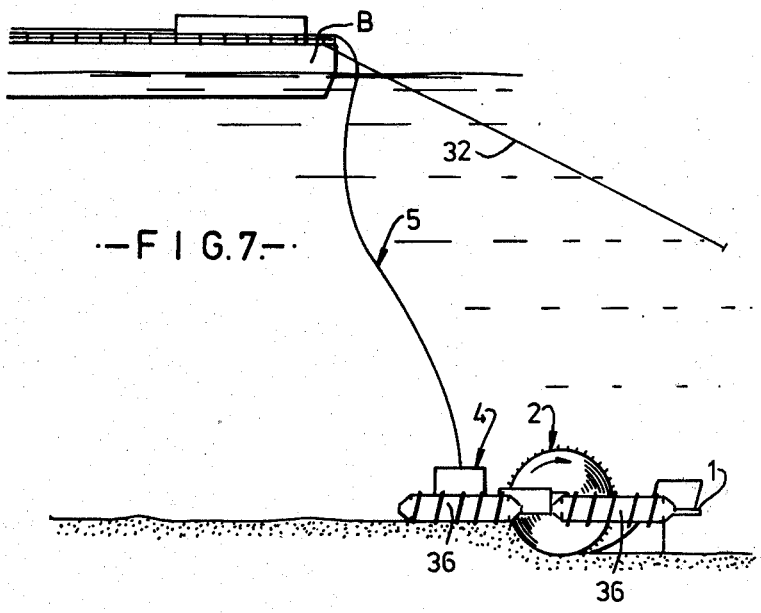
-FIG.7.-

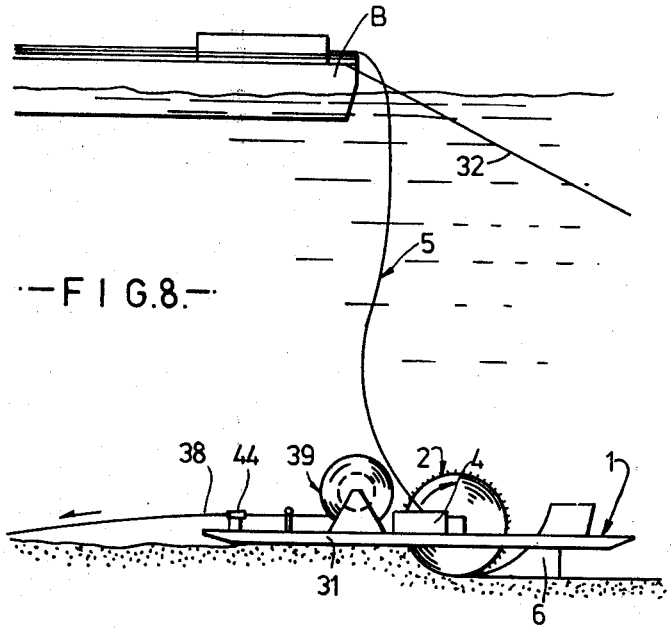
—FIG.8.—
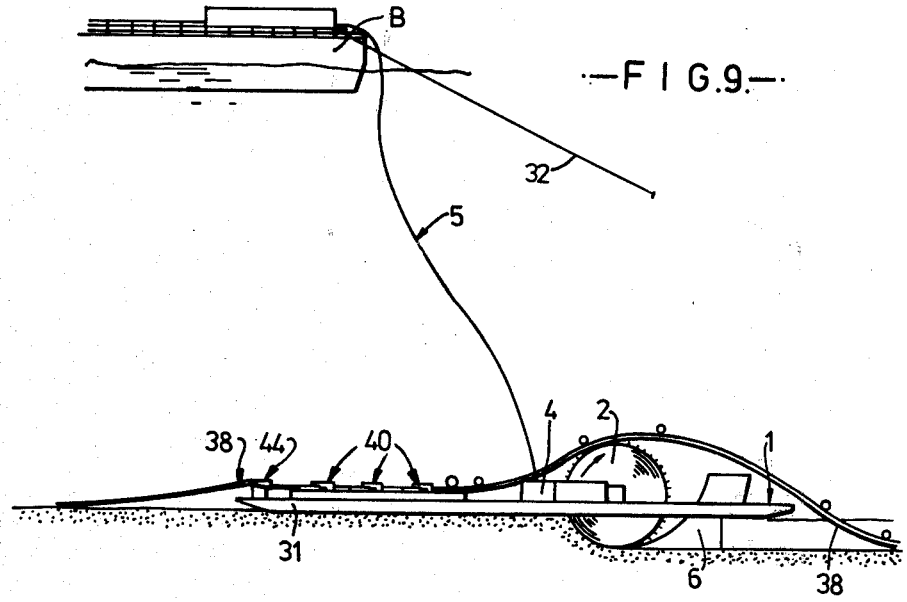
—FIG.9.—

TRENCH DIGGING APPARATUS AND BEARING THEREFOR

DESCRIPTION

The present invention relates to an apparatus for digging a trench through a variety of materials.

Various types of trench digging apparatus are already known, though these different types of apparatus are specifically designed to operate in a particular material or range of materials. For example, an endless bucket scoop trench digger is best suited for use in excavating in sandy and clay regions. However, it is of no real use in rocky regions. In such latter regions rotating cutters have to be used.

When trench digging apparatus is designed for use underwater for, for example, excavating a trench to bury a pipeline or cable in the sea bed, high powered water jets may be used to fluidize sandy regions and suction means can be used to direct the fluidized material away. Rotating cutters can also be provided to enable such apparatus to operate in regions of clay. Also, bucket scoop excavators may be used underwater in particular sea bed materials.

However, when it is necessary to excavate a continuous trench through various different materials e.g. sand, sandstone, limestone and chalk, the above known trench digging apparatus cannot operate efficiently at all times. In an attempt to provide a trench digging apparatus for use with varying terrain, a type of endless chain digger has been conceived, in which the chain links carry picks. However, while this apparatus can operate relatively efficiently in dry conditions, wet conditions result in the apparatus breaking down due to the endless chain becoming clogged, and the relative movement of the links becoming restricted. Underwater usage of such apparatus is clearly not desirable due to the large number of moving parts open to the corrosive properties of water.

SUMMARY OF THE INVENTION

The object of the present invention is to provide a trench digging apparatus which can be used in varying terrain and which may be equally well operated underwater.

According to the present invention there is provided a trench digging apparatus comprising a cutter wheel with picks projecting from the outer periphery thereof, and drive means arranged to rotate the cutter wheel about a substantially horizontal axis.

In a preferred embodiment of the present invention the apparatus comprises a basic frame on which the cutter wheel is mounted for rotation. The drive means for the cutter wheel is preferably an electric motor. Alternatively however one or more hydraulic motors may be located within the cutter wheel. Also mounted on the frame are a plough and deflection blade for clearing material from the trench as it is cut by the wheel.

The cutter wheel is supported on the basic frame in a suport frame which is pivotally mounted on the basic frame. The support frame is pivoted by cylinders i.e. hydraulic or pneumatic, about a horizontal axis, spherical and eccentric bearings allowing the support frame to be also pivoted by the cylinders, to a small degree about a vertical axis. Pivotal movement about the horizontal axis enables the cutter wheel to be lifted out of a trench or lowered into contact with the sea bed, and enables the trench depth to be adjusted as desired. The limited pivotal movement about a vertical axis provides the apparatus with a large turning circle e.g. 250 meters, and also enables any crabbing of the apparatus to be corrected. Further by moving the cutter wheel to and fro about the vertical axis it may enhance the cutting of various materials or may free the apparatus if it becomes stuck in a particular material.

The apparatus is preferably driven by motorized tracks, though alternatively self propulsion may be provided by rotating Archimedean screws secured to the frame, or by different types of winches provided on the apparatus to haul the apparatus along a previously laid guide cable. These methods of propulsion are applicable both to land and underwater operation. Alternatively the apparatus may be towed and if the apparatus is towed underwater, this may be effected by winches on an anchored attendant barge or by a moving vessel.

The present invention will now be further described, by way of example, with reference to the accompanying drawings, in which:

BRIEF DESCRIPTION OF THE DRAWINGS

FIG. 1 is a rear perspective view of a preferred embodiment of apparatus constructed according to the present invention, FIG. 2 is a rear perspective view of the apparatus of FIG. 1, partially disassembled, FIG. 3 is a sectional view of part of the apparatus of FIGS. 1 and 2, taken longitudinally of the apparatus, showing the pivotal support for the cutter wheel, FIG. 5 is a cross-sectional view of one of the hinge joints supporting the cutter wheel; and FIG. 6 shows a winch and skid embodiment utilized as the propelling apparatus for the present invention, FIG. 7 shows hydraulically driven Archimedean screws utilized as the propelling apparatus for the present invention;

FIG. 8 shows a drum winch winding a guide wire utilized as the propelling apparatus for the present invention; and FIG. 9 shows a linear winch utilized as the propelling apparatus for the present invention.

Figure 4:
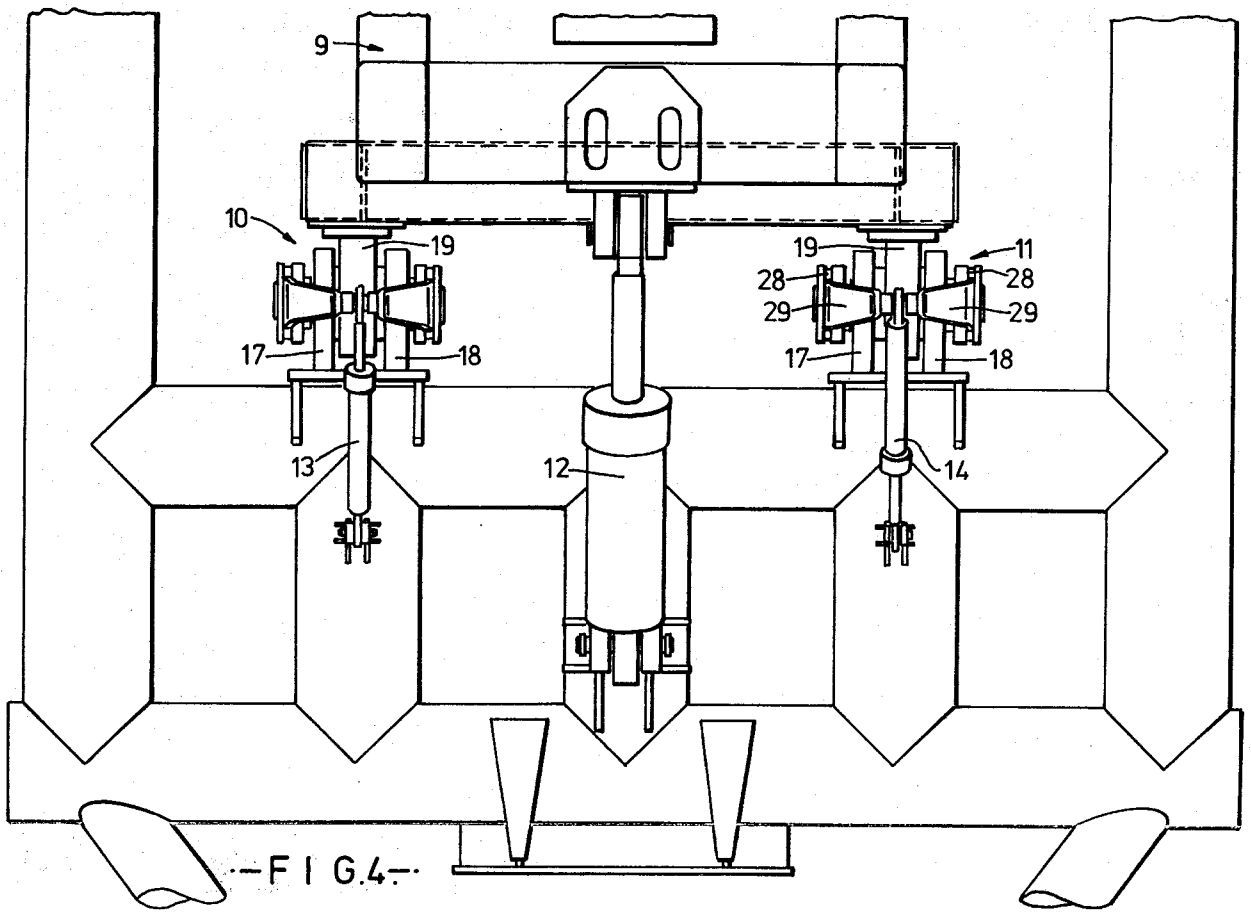
FIG. 4 is a plan view of the part of the apparatus illustrated in section in FIG. 3.

In all of the embodiments of the present invention illustrated in the accompanying drawings, the apparatus is for use underwater. However the apparatus may equally well be used on dry land.

DETAILED DESCRIPTION OF THE DRAWINGS

A preferred embodiment of the present invention is shown in FIGS. 1 to 5 of the accompanying drawings. This apparatus is for use underwater and basically comprises a tubular framework 1 upon which a cutter wheel 2 is mounted for rotation about a generally horizontal axis. In use the cutter wheel 2 projects below the framework 1 and is provided with picks 3 which extend from its periphery in desired patterns. Also provided on framework 1 is an electric drive motor 4 for the cutter wheel 2, this motor 4 receiving electrical power via an umbilical cable 5 which is connected to an attendant barge B (see FIG. 6). Alternatively one or more hydraulic motors (not shown) can power the cutter wheel 2 and can possibly be located within the actual cutter wheel 2. In use, the cutter wheel 2 rotates against the direction of travel of the apparatus (see arrow A in FIG. 1) to excavate a trench T. This ripping operation builds up bed material in front of the cutter wheel 2 and a jetting arm 1*a* fed from water intakes 1*b*, serves to continuously dispose this bed material to enable the apparatus to proceed. Behind the cutter wheel 2, depending from framework 1, is a plough 6 which is hinged to framework 1. The plough 6 rests by virtue of its own weight, on the bottom of trench T and may be lifted from or lowered into the trench by cylinder 6*a*. In use the plough 6 clears loose material in the trench T to the side of the trench and lays a guide wire C which passes through the plough 6, on the bottom of the trench, which guide wire is used to guide the subsequent operation of pipe or cable laying apparatus. The guide wire C is fed from an attendant barge to a guide 7 on the apparatus.

The apparatus also includes motorized tracks 8 which propel the apparatus along the sea bed, the tracks on each side of the apparatus being independently controllable to enable the apparatus to be steered. However any suitable alternative means of self-propulsion can be used or the apparatus can be towed. Preferably closed circuit television (not shown) is used on the apparatus to quickly and continuously monitor the performance and the type of terrain encountered.

To raise and lower the apparatus relative to the sea bed buoyancy tanks BT are provided and these can be filled or emptied of water as required, by suitable valve means not evident from the accompanying drawings.

Referring now to FIGS. 3 and 4 of the accompanying drawings where the support for cutter wheel 2 is illustrated in detail, cutter wheel 2 is rotatably mounted on support frame 9, support frame 9 being pivotably mounted by bearings 10 and 11 on the basic framework 1 of the apparatus. Hydraulic cylinder 12 controls pivotal movement of support frame 9 (see full line and dashed lines in FIG. 3) and thus controls the raising and lowering of the cutter wheel 2, to or from a work position in which the cutter wheel 2 projects below basic framework 1. Adjustment of cylinder 12 also adjusts the trench depth.

Referring to FIGS. 3 and 4 it is noted that the bearings 10 and 11 for the support frame 9 are spherical and eccentric bearings adjustable by hydraulic cylinder 13 and 14 respectively, one such bearing being shown in enlarged cross-section in FIG. 5. Each bearing basically comprises a shaft 15 which has an enlarged diameter, centrally located, cylindrical portion 16, this cylindrical portion 16 being eccentric with respect to the longitudinal axis of shaft 15. The end portions 15′ and 15″ of shaft 51 are rotatably mounted in sections 17 and 18 of the framework 1 and section 19 of support frame 9 is rotatably mounted on a ring member 20 which is supported on cylindrical portion 16 of shaft 15. Ring member 20 has a part spherical outer surface 21 which mates with a complementary surface 22 in section 19 of support frame 9. Annular thrust plates 23 and 24 are located between the end faces of cylindrical portion 16 and sections 17 and 18 of framework 1 and a resilient, compressible ring 25 is sandwiched between further thrust plates 26 and 27 to form a compressible assembly located between ring member 20 and section 18 of framework 1. This compressible assembly is located on the inboard side of each bearing and its function will be described later. The end portions 15′ and 15″ of shaft 15 are gripped by clamping members 28, extensions 29 from the respective clamping members, being interconnected by an axle 30 upon which one end of a hydraulic cylinder 13,14 is rotatably mounted. The other end of cylinder 13,14 is pivotally mounted on framework 1. Thus by adjusting the length of cylinders 13,14, shaft 15 can be rotated about its longitudinal axis. If both cylinders 13,14 are retracted then shafts 15 will rotate causing the central axis of cylindrical portions 16 to move with respect to the direction of travel of the apparatus. Thus the pivot points for support frame 9 move towards the front or rear of the apparatus. However, should one cylinder be adjusted to a different length from the other, then the support frame and thus the cutter wheel 2, will tend to angle itself with respect to the longitudinal axis of the apparatus. To allow this to happen compressible assembly 25,26,27 is provided in each bearing 10,11, the annular rings 20 compressing said compressible assemblies 25,26,27 and thus, together with a spherical bearing connection (not shown) between cylinder 12 and support frame 9, allowing this turn adjustment to occur. In practice this movement about a vertical axis is only of the order of a few degrees and will for example constitute a turning circle of approximately 250 meters. However this adjustment facility also enables any crabbing of the apparatus, when in use, to be corrected. Further, by moving the cutter wheel 2, to and fro about the vertical axis it can enhance the cutting performance in various materials or may free the apparatus if it becomes stuck in a particular material.

In FIGS. 6 to 9, various embodiments of the present invention are illustrated, the differences between these embodiments arising from their respective means of propulsion. Features equivalent to features of FIGS. 1 to 5 are identified by the same reference numerals. In the embodiment shown in FIG. 6, wherein frame 1 rests on skids 31 on the sea bed, the attendant barge B is anchored by cables 32 and a winch (not shown) winches the apparatus along the sea bed, the winch cable 33 being connected to a towing skid 34 which prevents the apparatus itself from being lifted off the sea bed as the cable 33 is wound in. Alternatively the winch cable can be directly connected to the apparatus but is passed around an anchored pulley which has the same effect as the towing skid of the embodiment in FIG. 6.

In the embodiment illustrated in FIG. 7, the frame 1 is supported on worm drives 36 which are in the form of Archimedean screws driven by hydraulic means located within the respective screws.

The embodiments of FIGS. 8 and 9 both rely upon the provision of a prelaid guide wire 38 to enable the apparatus to be moved along the frame 1 resting on the sea bed on skids 31. One end of the guide wire 38 is anchored to the terrain and the apparatus effectively hauls itself along the sea bed. In the embodiment of FIG. 8, a drum winch 39 is mounted on frame 1 and winds the guide wire 38 in, to thus propel the apparatus. In the embodiment of FIG. 9, a linear winch 40 hauls the apparatus along guide wire 38, the guide wire being guided over the cutter wheel 2 to the rear of the apparatus.

As an alternative to using guide wire 38, a chain (not shown) can be substituted which is anchored at one end, a motorized toothed wheel on the apparatus, gripping the chain and pulling the apparatus therealong. In all of the embodiments of FIGS. 6 to 9, a wire cleaning device 44 is provided at the front end of the frame 1.

In operation, the cutting wheel 2 rotates in all of the above described embodiments, against the direction of movement of the apparatus, thus effectively ripping the trench out of the terrain, the individual picks being angled with respect to the periphery of the cutting wheel.

Thus the present invention provides a simple but effective apparatus for use in digging a trench in all types of terrain, the basic apparatus having the minimum number of moving parts.

We claim:

1. A trench digging apparatus comprising a basic framework, a cutter wheel rotatably mounted on a support frame, drive means for rotating the cutter wheel about a substantially horizontal axis, cutting means projecting from the outer periphery of the cutter wheel, said support frame being pivotally mounted and supported on the basic framework by hinge bearing means, said support frame being pivotally controlled by cylinder means connected to said support frame and said basic framework, said hinge bearing means allowing pivotal movement about an axis extending generally horizontally and transversely of the framework, and a limited amount of movement about a generally vertical axis, each hinge bearing means comprising a shaft having an enlarged diameter centrally located cylindrical portion, the cylindrical portion being eccentric with respect to the longitudinal axis of the shaft, end portions of said shaft being rotatably located in the basic framework and a ring member rotatably mounted on said cylindrical portion, the support frame being rotatably mounted on said ring member.

2. A trench digging apparatus as claimed in claim 1 wherein said cutting means are a plurality of picks.

3. Apparatus according to claim 1, wherein the ring member has a part spherical outer surface which mates with a complementary surface on the support frame.

4. Apparatus according to claim 3, wherein the ring member is supported on said cylindrical portion of the shaft between thrust plates, a resilient member holding the ring member in position between the thrust plates but allowing the ring member to move axially of said cylindrical portion of the shaft should sufficient force be applied to the ring member to compress said resilient member.

5. Apparatus according to claim 4, wherein clamping members are secured to the end portions of the shaft, a hydraulic ram being arranged to act upon said clamping members to rotate said shaft about its longitudinal axis.

6. Apparatus according to claim 1, wherein the apparatus is propelled by motorised tracks.

7. Apparatus according to claim 1, wherein the apparatus is provided with Archimedean screws which support the apparatus and can propel the apparatus as required.

8. Apparatus according to claim 1, wherein the apparatus is supported on skids and is adapted to be towed.

9. Apparatus according to claim 1, wherein a winch is provided for use in hauling the apparatus forwards along a prelaid guide wire or chain.

10. Apparatus according to claim 1, wherein a trailing plough is provided for clearing loose material from a trench.

11. Apparatus according to claim 1, wherein buoyancy tanks are provided to enable the apparatus to be raised from and lowered to the sea bed when used underwater.

* * * * *